US005605140A

United States Patent [19]

Griffin

[11] Patent Number: 5,605,140

[45] Date of Patent: Feb. 25, 1997

[54] TOY GUN WITH CONCEALED SECONDARY BARREL

[75] Inventor: David R. Griffin, Morning View, Ky.

[73] Assignee: Tonka Corporation, Pawtucket, R.I.

[21] Appl. No.: 375,290

[22] Filed: Jan. 19, 1995

[51] Int. Cl.[6] ..... F41B 11/14

[52] U.S. Cl. ..... 124/59; 124/66

[58] Field of Search ..... 42/54; 124/56, 124/59, 64, 65, 66, 67

[56] References Cited

U.S. PATENT DOCUMENTS

| | | | |
|---|---|---|---|
| 2,581,505 | 1/1952 | Wells . | |
| 2,922,412 | 1/1960 | Hosbach, Jr. . | |
| 3,262,440 | 7/1966 | Kuhn | 124/67 |
| 4,819,609 | 4/1989 | Tippmann | 124/72 |
| 4,843,751 | 7/1989 | Ferri | 42/54 |
| 4,848,307 | 7/1989 | Tsao | 124/59 |
| 5,186,156 | 2/1993 | Clayton | 124/59 |
| 5,267,549 | 12/1993 | Webber | 124/65 |
| 5,343,850 | 9/1994 | Steer | 124/59 X |

OTHER PUBLICATIONS

"Pistol that shoots around the corner", from Kenner Products 1966 Catalog.

Lewis Winant, Firearms Curiosa, Copyright Date 1955, pp. 210–211.

*Primary Examiner*—John A. Ricci

*Attorney, Agent, or Firm*—Kurt R. Benson

[57] ABSTRACT

A toy gun includes a gun body having a handle portion, a primary barrel on the gun body and a concealed secondary barrel in the handle portion. The gun further includes a piston and cylinder assembly which is operable for selectively delivering blasts of compressed air to the primary or secondary barrels for selectively launching projectiles therefrom.

6 Claims, 6 Drawing Sheets

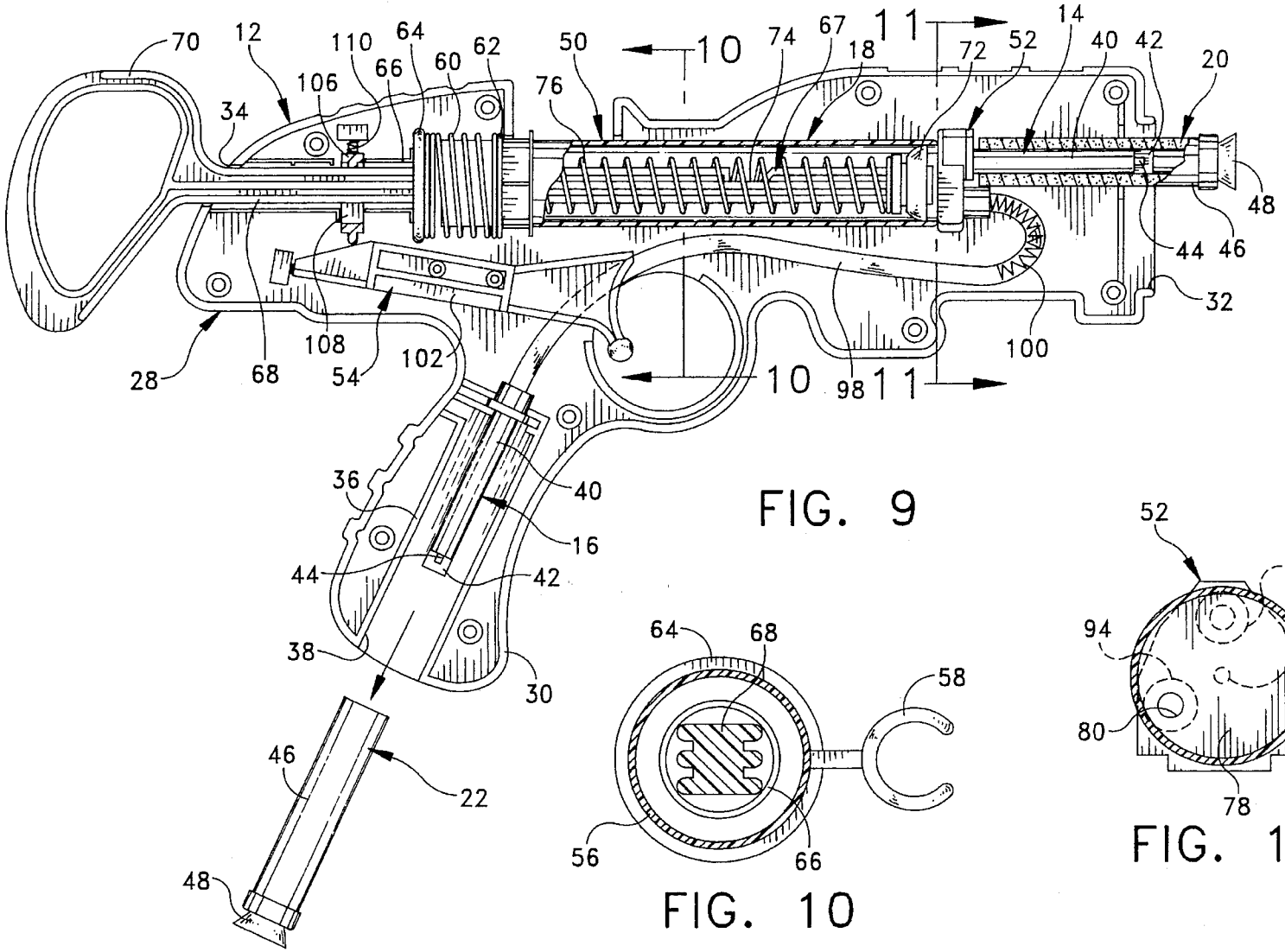
FIG. 9
FIG. 10
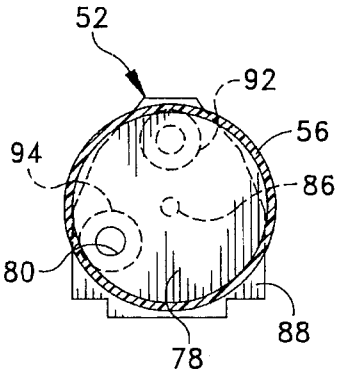
FIG. 11

TOY GUN WITH CONCEALED SECONDARY BARREL

BACKGROUND AND SUMMARY OF THE INVENTION

The instant invention relates to toy guns, and more particularly to a toy gun which is selectively actuatable for alternatively launching a primary projectile from a primary barrel or a secondary projectile from a secondary barrel which is concealed in a handle portion of the gun.

Toy guns and projectile launchers have generally been found to have significant levels of play value. Further, for safety reasons, projectile launchers which are adapted for launching relatively soft, safe, foam projectiles have been found to have increased levels of appeal. Accordingly, a variety of different toy guns and the like which are specifically adapted for launching soft foam projectiles have enjoyed significant levels of commercial success in recent years. Nevertheless, it has been found that toy guns of this type which incorporate new, unique, and amusing features frequently have increased levels of appeal.

The instant invention provides a unique toy gun which is adapted for alternatively firing a primary projectile from a primary barrel thereof or for firing a secondary projectile from a secondary barrel thereof which is concealed in a handle portion of the gun. Accordingly, while the toy gun may appear to be rendered inoperative and in an unloaded condition once the primary projectile has been fired from the primary barrel thereof, it may still be possible for a user to fire the secondary projectile from the concealed secondary barrel after the first projectile has been discharged from the gun. Accordingly, the toy gun of the instant invention has an increased level of play value as a result of the concealed or secret nature of the secondary barrel which is located in the handle portion thereof.

Guns and projectile launchers representing the closest prior art to the subject invention of which the Applicant is aware are disclosed in U.S. Patents to Wells, U.S. Pat. No. 2,581,505; Hosbach, Jr., U.S. Pat. No. 2,922,412; Tippmann, U.S. Pat. No. 4,819,609; Ferri, U.S. Pat. No. 4,843,751; Tsao, U.S. Pat. No. 4,848,307; and Clayton, U.S. Pat. No. 5,186,156, and a 1955 publication from Bonanza Books of New York entitled "Firearms Curiosa" by Lewis Winant. However, while these references disclose a variety of real and toy guns and projectile launchers, they fall to suggest a toy gun which is adapted for alternatively launching a secondary projectile from a handle portion of a gun while the handle portion is held in the hand of a user, and hence, they are believed to be of only general interest with respect to the toy gun of the subject invention.

The toy gun of the instant invention more specifically comprises a primary barrel for guiding a primary projectile in a first direction, a handle extending angularly from the primary barrel, and a secondary barrel substantially concealed within the handle and coextending a distance therewith for guiding a secondary projectile in a second direction which is in angular relation to the first direction. The toy gun further includes a launching mechanism which selectively alternatively communicates with the first and second barrels for selectively alternatively launching the primary projectile from the primary barrel or the secondary projectile from the secondary barrel. The launching mechanism preferably comprises a piston and cylinder assembly which is selectively operative for delivering a blast of compressed air to the primary barrel for launching the primary projectile therefrom or for alternatively delivering a blast of compressed air to the secondary barrel for launching the secondary projectile therefrom. Further, the cylinder of the piston and cylinder assembly is preferably axially rotatable between first and second positions, and the launching mechanism preferably includes a distribution plate which communicates with the cylinder for alternatively distributing a blast of compressed air to the primary barrel when the cylinder is in the first position thereof or to the secondary barrel when the cylinder is in the second position thereof. More specifically, the cylinder preferably has a forward or first end having an eccentrically disposed aperture therein, and the distributor plate preferably engages the first end of the cylinder for selectively distributing air passing through the aperture to the primary barrel when the cylinder is in the first position thereof or to the secondary barrel when the cylinder is in the second position thereof. Still further, the launching mechanism preferably includes a trigger which is positioned for engagement by an index finger of a user when the handle portion is received in the same hand of the user. The trigger is preferably pivotable rearwardly toward the handle portion, and the launching mechanism is preferably selectively controllable for determining whether a projectile is launched from the primary barrel or from the secondary barrel in response to pulling the trigger rearwardly.

Accordingly, it is seen that the instant invention provides an effective toy gun which is capable of alternatively launching a projectile from a main or primary barrel of the gun or from a secondary barrel which is concealed in the handle portion of the gun. Further, the toy gun is preferably adapted for launching relatively soft, safe foam projectiles from the primary and secondary barrels thereof utilizing blasts of compressed air so that the toy gun not only has increased play value, but it also represents a relatively safe air-powered toy gun which can be effectively and safely utilized in various play formats.

Accordingly, it is a primary object of the instant invention to provide a toy gun which is capable of alternatively launching projectiles from a primary barrel or from a secondary barrel which is concealed within a handle portion of the gun.

Another object of the instant invention is to provide a toy gun which is adapted for launching relatively soft, safe foam projectiles and which has an increased level of play value.

An even still further object of the instant invention is to provide a toy gun which is adapted for launching soft, safe foam projectiles with compressed air wherein projectiles can be alternatively launched from a primary barrel or a secondary barrel located in a handle portion of the gun.

Other objects, features and advantages of the invention shall become apparent as the description thereof proceeds when considered with the accompanying illustrative drawings.

DESCRIPTION OF THE DRAWINGS

In the drawings which illustrate the best mode presently contemplated for carrying out the present invention:

FIG. 9 is a side elevational view of the gun shown in partial section with the right body portion removed and immediately after firing a projectile from the secondary barrel;

FIG. 10 is a sectional view taken along line 10—10 in FIG. 9;

FIG. 11 is a sectional view taken along line 11—11 in FIG. 9;

DESCRIPTION OF THE INVENTION

Figure 1:
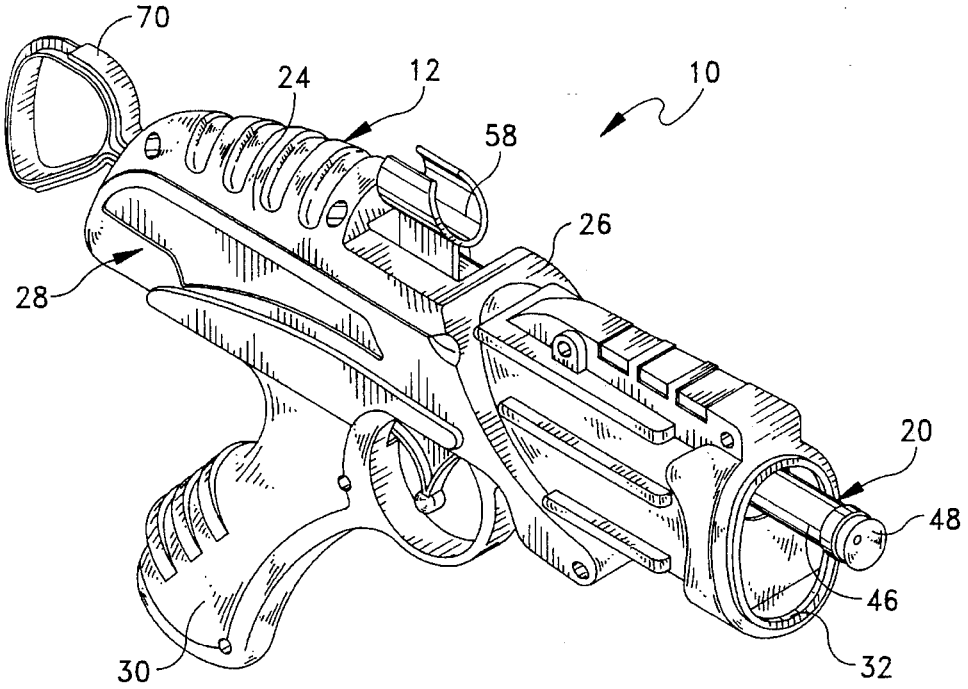
FIG. 1 is a right-side perspective view of the toy gun of the instant invention.
Figure 2:
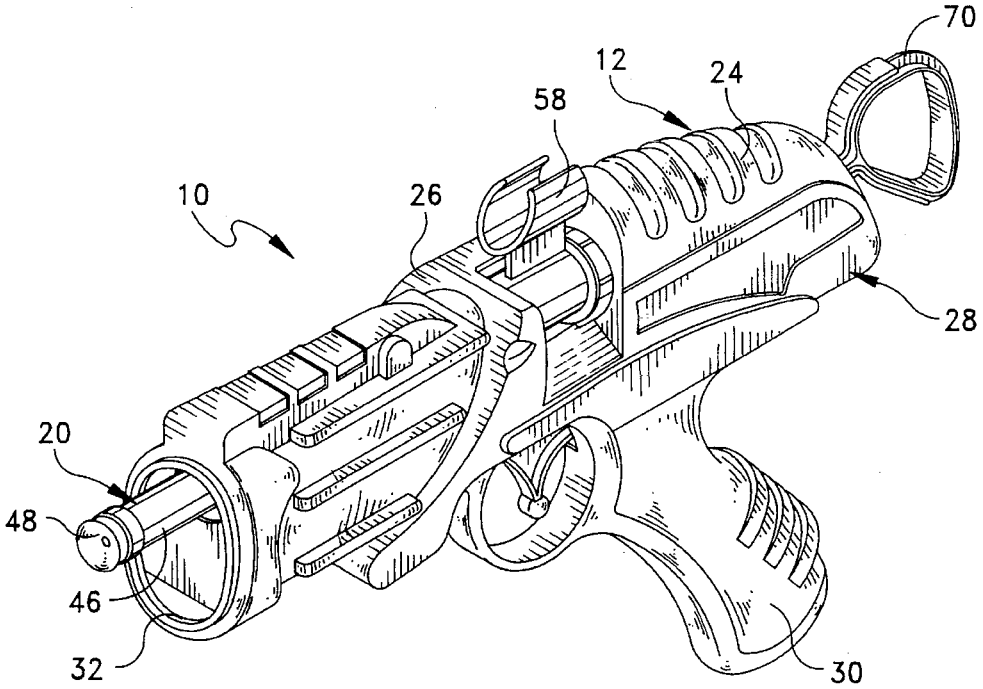
FIG. 2 is a left-side perspective view thereof.
Figure 3:
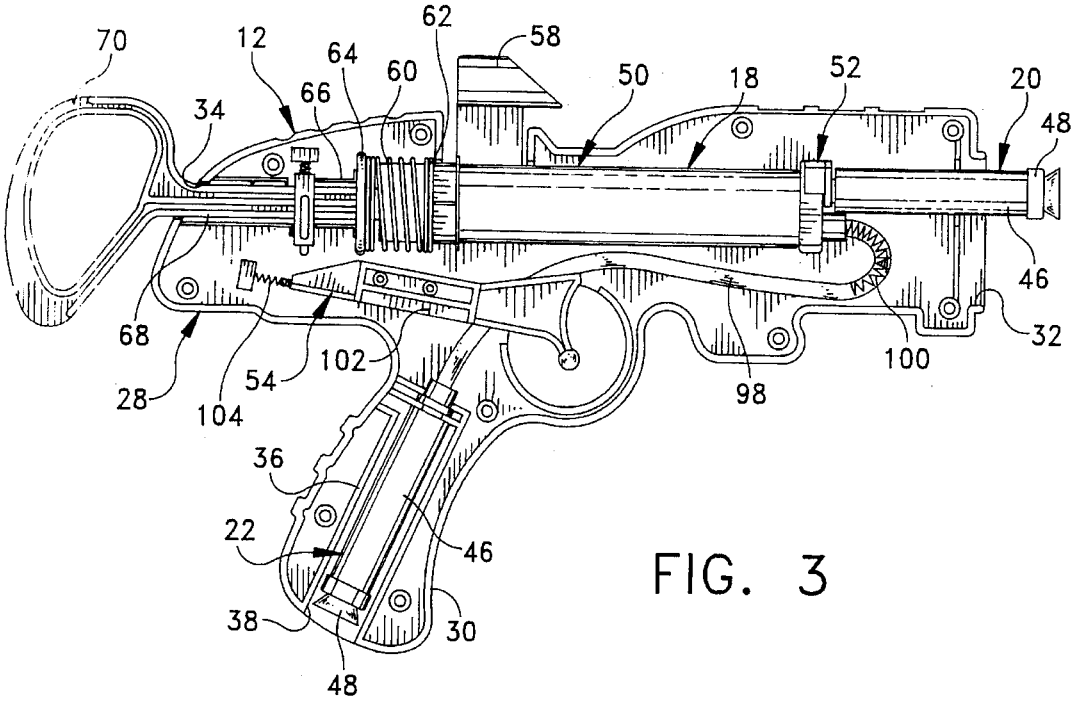
FIG. 3 is a right-side elevational view thereof with the right body portion removed.
Figure 4:
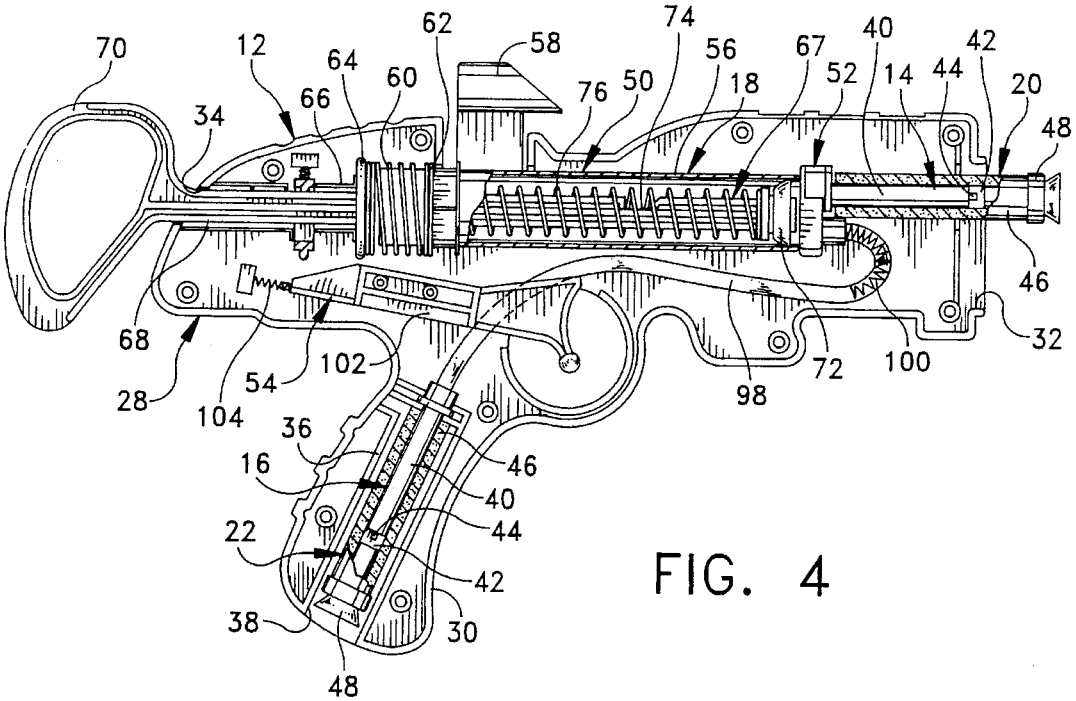
FIG. 4 is a similar view shown in partial section.
Figure 5:
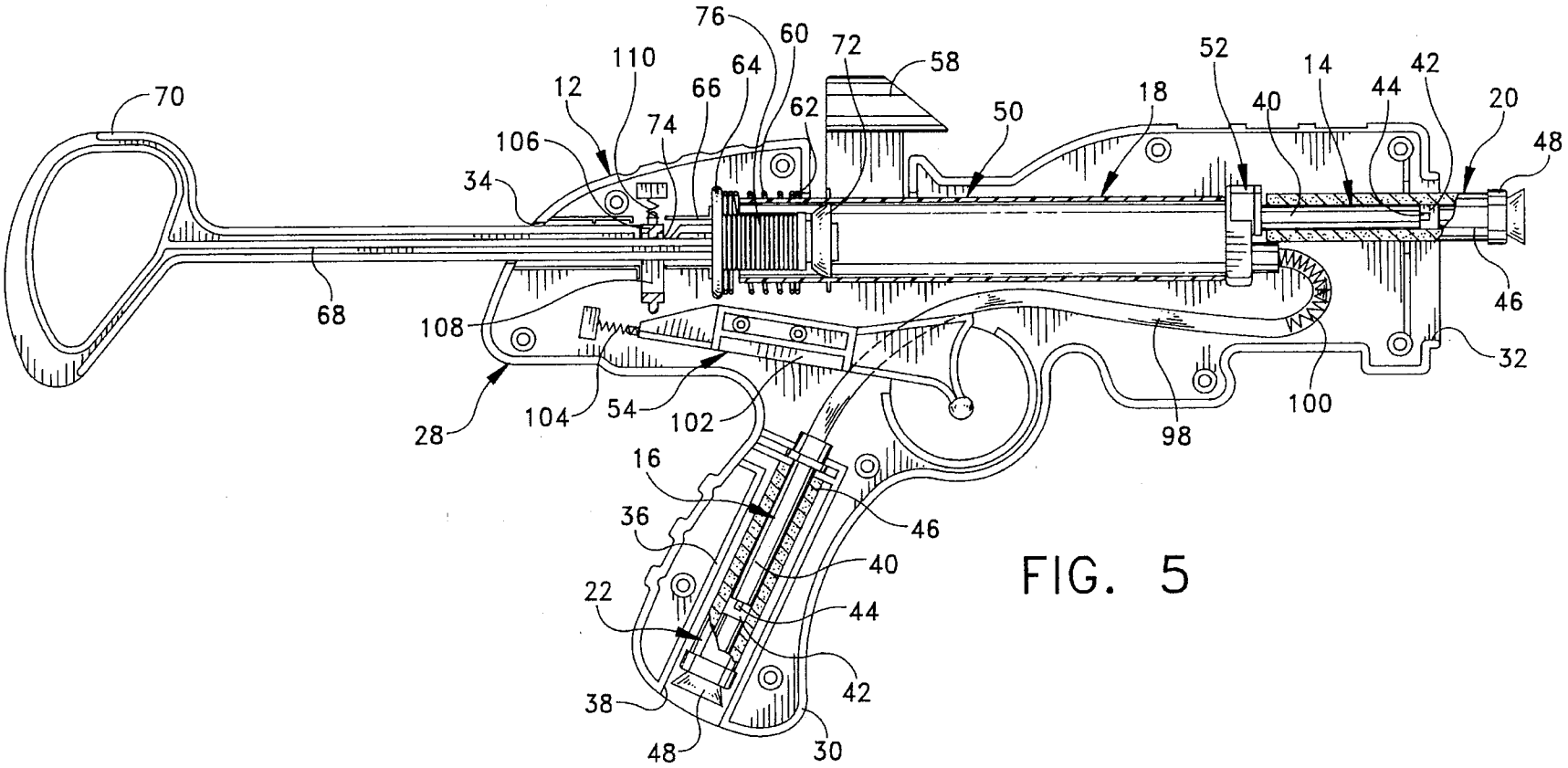
FIG. 5 is a similar view shown in partial section with the gun in a cocked position.
Figures 6, 7, 8:
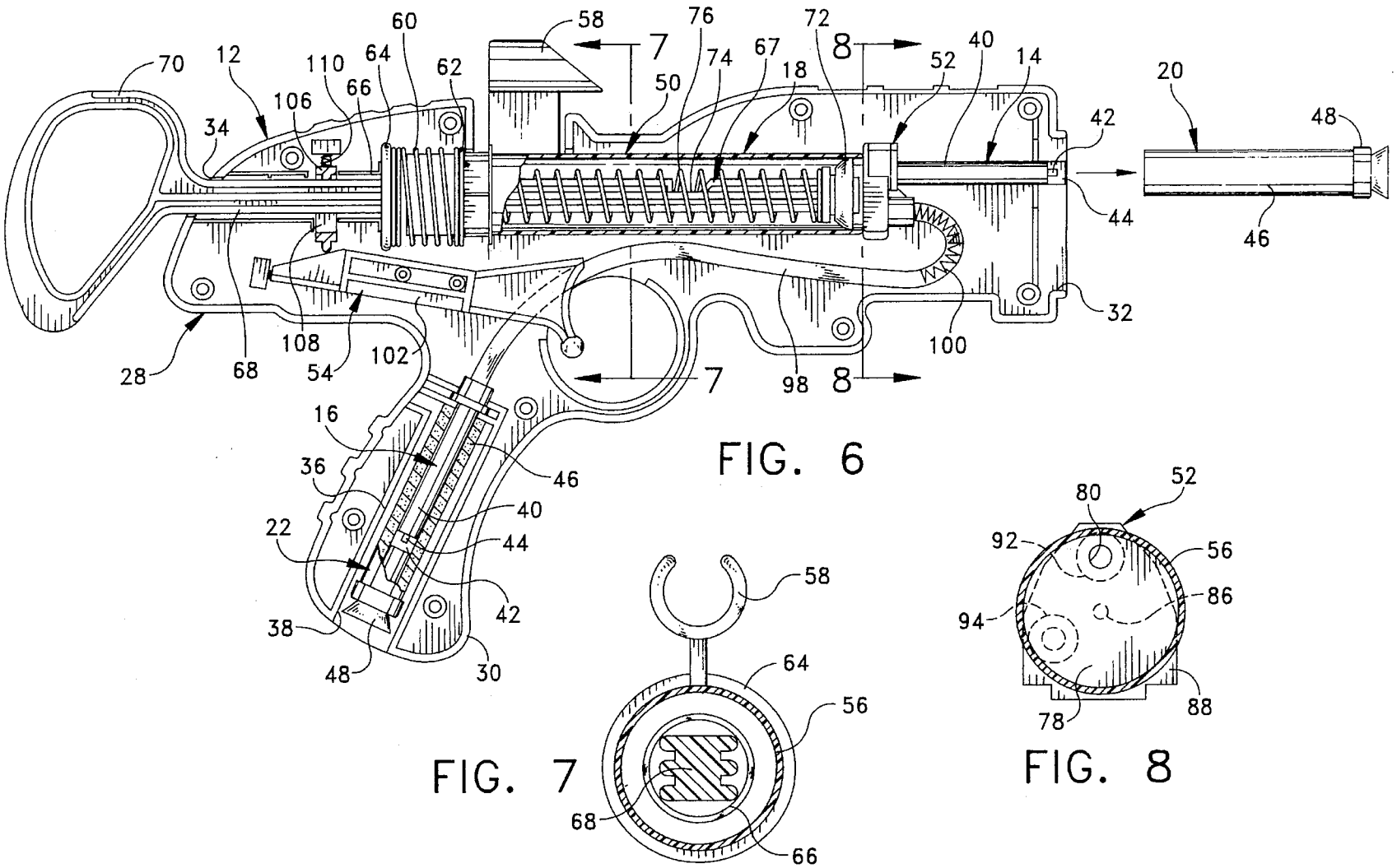
FIG. 6 is a similar view immediately after launching a projectile from the primary barrel.
FIG. 7 is a sectional view taken along line 7—7 in FIG. 6.
FIG. 8 is a sectional view taken along line 8—8 in FIG. 6.

Referring now to the drawings, the toy gun of the instant invention is illustrated in FIGS. 1–13 and generally indicated at 10 in FIGS. 1 and 2. The toy gun 10 comprises a body portion generally indicated at 12, a primary barrel or launching tube generally indicated at 14, a secondary barrel or launching tube generally indicated at 16, and a launching mechanism generally indicated at 18. As illustrated in FIGS. 7 and 9, the launching mechanism 18 is selectively operable for alternatively launching a first projectile generally indicated at 20 from the first launching tube 14 or for launching a second projectile generally indicated at 22 from the second launching tube 16. Further, because the secondary launching tube 16 is concealed within a handle portion of the gun body 12, the gun 10 can be used to trick or to fool an opponent in a simulated battle by firing the concealed secondary projectile 22 after the gun 10 has apparently been rendered fully unloaded as a result of having fired the first projectile 20 from the primary launching tube 14.

The body portion 12 comprises a split housing including right and left side portions 24 and 26, respectively, which cooperate to define an upper or stock portion generally indicated at 28 and a handle portion 30 which depends angularly from the stock portion 28. The side portions 24 and 26 are preferably each integrally molded from a suitable plastic material, and, as illustrated in FIGS. 3–6 and 9, they cooperate to define a front or muzzle opening 32 and a rear or piston opening 34 in the stock portion 28. The side portions 24 and 26 are further adapted to provide an inner tubular section 36 in the handle portion 30 which terminates in a downwardly directed secondary muzzle opening 38.

The primary barrel or launching tube 14 is disposed in the upper stock portion 28 so that it extends partially through the primary muzzle opening 32. The primary launching tube 14 comprises an elongated hollow tubular portion 40 which extends integrally from a forward portion of the launching mechanism 18 as will hereinafter be more fully set forth. The primary launching tube 14 further comprises a flattened terminal end portion 42 having openings 44 on opposite sides thereof. The primary launching tube 14 is adapted for use in connection with the primary projectile 20, and accordingly, the projectile 20 is formed so as to include an elongated tubular shaft portion 46 which is made from a suitable soft foam material and dimensioned to be snugly received on the tubular member 40. The primary projectile 20 further comprises a conventional suction cup end portion 48 which enables the projectile 20 to be temporarily retained on a wall or other surface with which it comes into engagement after being launched from the gun 10.

The secondary launching tube 16 is essentially identical in construction to the primary launching tube 14, and it is adapted for use in combination with a secondary projectile 22 which is essentially identical in construction to the primary projectile 20. It will be understood, however, that one or both of the primary and secondary launching tubes 14 and 16, as well as one or both of the primary and secondary projectiles 20 and 22, could alternatively be embodied in a variety of different forms within the contemplated scope of the subject invention. In any event, the secondary launching tube 16 is mounted in the handle portion 30 so that when the secondary projectile 22 is received thereon, both the launching tube 40 and the projectile 22 are concealed within the interior of the handle portion 30.

The launching mechanism 18 comprises a piston and cylinder assembly generally indicated at 50, an air distribution plate assembly generally indicated at 52, and a trigger assembly generally indicated at 54. The piston and cylinder assembly 18 comprises a tubular cylinder 56 which is rotatably mounted in the body portion 12 for movement between the first position illustrated in FIGS. 3–6 and the second position illustrated in FIG. 9. The cylinder 56 includes a lever or handle portion 58 which is adapted for holding an additional projectile 20 or 22, and which extends outwardly through an opening in the body portion 12 for rotating the cylinder 56 between the first and second positions thereof, and a coil spring 60 is received on the exterior of the cylinder 56 between an integral flange 62 thereon and a washer 64 which abuts a flange 66 on the interior of the body portion 12. Accordingly, the spring 60 biases the cylinder 56 to a forward position in the body portion 12 while nevertheless allowing the cylinder 56 to be rotated between the first and second positions thereof. The piston and cylinder assembly 50 further comprises a piston 67, including a piston rod 68 having a handle 70 on one end thereof and a piston seal 72 on the opposite end thereof. The piston rod 68 has a cocking or loading notch 74 formed therein, and a coil spring 76 is received on the piston rod 68 for biasing it to a forward position in the cylinder 56. In this regard, the coil spring 76 actually engages the washer 64 for biasing the piston rod 68 to a forward position. The seal 72 is adapted to sealingly travel in the cylinder element 56 for producing a blast of compressed air as the piston element 67 travels forwardly in the cylinder 56.

Figure 12:
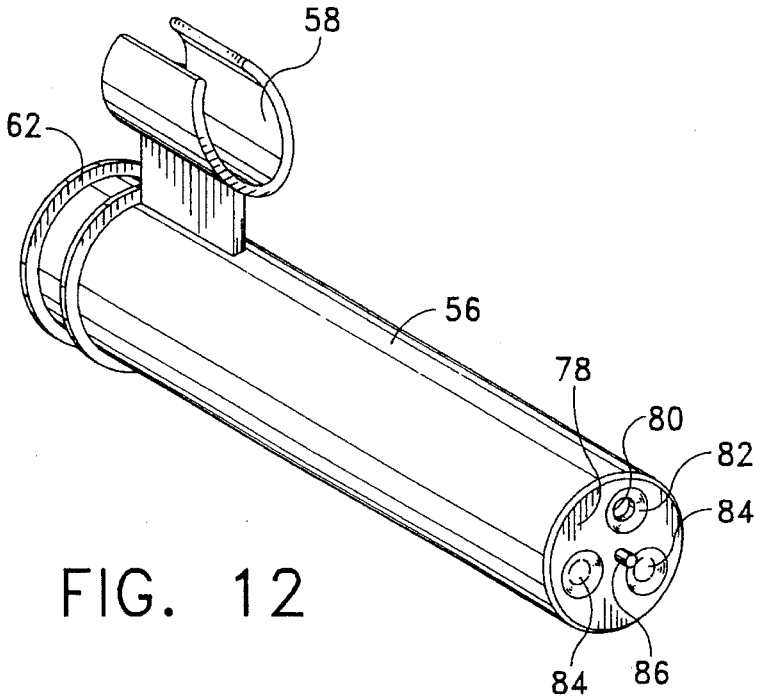
FIG. 12 is a perspective view of the cylinder of the gun.
Figure 13:
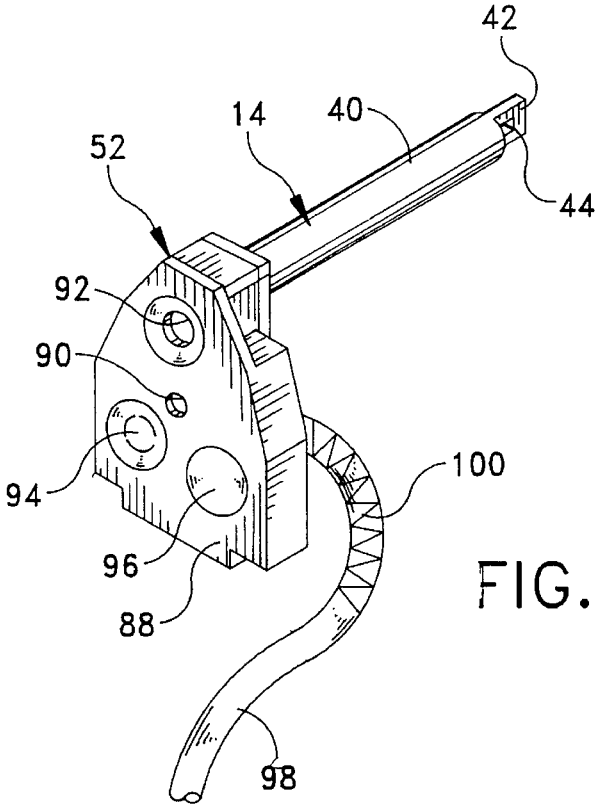
FIG. 13 is a perspective view of the distributor plate thereof.

The air distribution plate 52 is adapted for receiving compressed air from the cylinder 56 and for selectively distributing it to either the primary launching tube 14 or the secondary launching tube 16. In this regard, as illustrated in FIG. 12, the cylinder 56 includes a forward end 78 having an eccentrically positioned air outlet aperture 80 therein. The outlet aperture 80 has a rounded boss 82 formed therearound and two similarly formed bosses 84 are also provided on the end wall 78. However, the bosses 84 do not surround apertures 80, although they also function to properly align the cylinder 56 with the air distribution plate 52 in the first and second positions of the cylinder 56. Also extending from the forward end 78 of the cylinder 56 is a centrally located alignment pin 86. As illustrated in FIG. 13, the air distribution plate 52 comprises a plate 88 having a central aperture 90 and first and second concave apertured recesses 92 and 94, respectively formed therein. Also formed in the air distribution plate 88 is a dummy recess 96. The aperture 90 is adapted for receiving the alignment pin 86 therein in order to rotatably maintain the forward end 78 of the cylinder 50 in proper orientation with respect to the air distribution plate 52. Further, the bosses 82 and 84 are dimensioned to be received in the recesses 92, 94 and 96. The air distribution plate 52 is integrally formed with the primary launching tube 14 so that the aperture extending through the recess 92 communicates with the interior of the primary launching tube 14 for delivering compressed air thereto. The aperture extending through the recess 94, on the other hand, communicates with the interior of the secondary launching tube 16 through a connector tube 98 containing an internal reinforcing element 100. Accordingly, when the cylinder 56 is oriented so that the rounded boss 82 is received in the recess 92, compressed air from the cylinder 56 is delivered to the primary launching tube 14. On the other hand, when the cylinder 56 is oriented so that the boss 82 is received in the recess 94, compressed air from the cylinder 56 is delivered to the secondary launching tube 16 through the connector tube 98. As a result, it is possible to cause air to be selectively delivered to either the primary launching tube 14 or the secondary launching tube 16 by positioning the cylinder 56 in the first position thereof or the second position thereof, respectively.

The trigger assembly 54 is operative in a conventional manner for releasing the piston element 67 from the cocked or loaded position thereof so that it is advanced forwardly in the cylinder 56 for producing a blast of compressed air. The trigger assembly includes a trigger element 102 which is slidably mounted in the body portion 12 but biased to a forward position with a spring 104. The trigger assembly 54 further includes a latching member 106 having an aperture 108 therein. The latching member 106 is received on the piston rod 68 so that the piston rod 68 passes through the aperture 108, and the latching member 106 is biased to a downward position with a spring 110. Accordingly, when the piston rod 68 is drawn to its fully rearward position illustrated in FIG. 5, the latching member 106 is receivable in the notch 74 for releasably retaining the piston rod 68 in a cocked or loaded position. When the latching member 106 is in this position, the trigger element 102 is engageable with the bottom end of the latching member 106 to cam the latching member 106 upwardly out of the notch 74. As a result, the piston element 67 is released so that it is propelled forwardly in the cylinder 56 by the spring 76.

Accordingly, during use and operation of the toy gun 10, the projectile 20 is assembled on the launching tube 14 and the projectile 22 is assembled on the launching tube 16. The lever 58 is then manipulated to position the cylinder element 56 in either the first position thereof illustrated in FIGS. 3–6 or the second position thereof illustrated in FIG. 9. The piston rod 67 is then drawn rearwardly in the cylinder 56 until the latching member 106 is engaged in the notch 74. Thereafter the trigger assembly 54 can be manipulated to draw the trigger element 102 rearwardly so as to disengage the latching member 106 from the notch 74. If the cylinder 56 is in the first position thereof when the piston 67 is released, a blast of compressed air is delivered to the primary launching tube 14 through the distribution plate 52. Alternatively, if the cylinder 56 is in the second position thereof when the piston 67 is released, a blast of compressed air is delivered to the secondary launching tube 16 through the distribution plate 52. In this regard, obviously, when the cylinder 56 is in the second position thereof, it is important to properly aim the launching tube 16 toward a desired target before manipulating the trigger assembly 54 to release the latching member 106.

It is seen, therefore, that the instant invention provides an effective toy gun. The toy gun 10 is capable of effectively launching a first projectile from a first launching tube in a conventional manner or for launching a second projectile from a second launching tube which is concealed in a handle portion of the gun. Accordingly, the toy gun 10 enables the user to fire a concealed projectile by directing the handle portion 30 in a desired direction and operating the trigger assembly 52 in a conventional manner. This has the result of adding a new dimension of play value to the toy gun 10, and as a result, the toy gun of the instant invention has a significantly increased level of appeal and substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A toy gun for use in combination with primary and secondary projectiles comprising:

primary barrel means for guiding said primary projectile in a first direction;

handle means extending angularly from said primary barrel means;

secondary barrel means substantially concealed within said handle means and coextending a distance therewith for guiding said secondary projectile in a second direction which is in angular relation to said first direction; and launching means selectively communicating with said primary and secondary barrel means for selectively alternatively launching said primary projectile from said primary barrel means or said secondary projectile from said secondary barrel means, said launching means being selectively actuatable for alternatively delivering a blast of compressed air to said primary barrel means for launching said primary projectile therefrom or for delivering a blast of compressed air to said secondary barrel means for launching said secondary projectile therefrom.

2. In the toy gun of claim 1, said launching means comprising a cylinder and a piston in said cylinder, said cylinder communicating with both of said primary and secondary barrel means for selectively alternatively delivering blasts of compressed air thereto.

3. In the toy gun of claim 2, said cylinder being axially rotatable between first and second positions relative to said primary and secondary barrel means and said handle means, said launching means including a distributor plate communicating with said cylinder and rotationally repositioned with respect thereto as said cylinder is moved between the first and second positions thereof for selectively alternatively distributing a blast of compressed air from said cylinder to said primary barrel means when said cylinder is in the first position thereof or to said secondary barrel means when said cylinder is in the second position thereof.

4. In the toy gun of claim 3, said cylinder having a first end having an aperture therein, said distributor plate engaging said first end for selectively distributing air passing from said cylinder through said aperture to said primary barrel means when said cylinder is in the first position thereof and to said secondary barrel means when said cylinder is in the second position thereof.

5. In the toy gun of claim 1, said launching means including a trigger and means for selectively alternatively controlling said launching means for launching said primary projectile from said primary barrel or said secondary projectile from said secondary barrel in response to a predetermined manipulation of said trigger.

6. A toy gun for use in combination with primary and secondary projectiles comprising:

a gun body including a stock portion having a forward end and a pistol handle portion depending from said stock portion and terminating in a bottom end;

primary barrel means in said stock portion for guiding said primary projectile in a direction extending from the forward end of said stock portion;

secondary barrel means in said handle portion for guiding said secondary projectile in a direction extending from a bottom end of said handle portion; and launching means selectively communicating with said primary and secondary barrel means and controllable for selectively alternatively launching said primary projectile from said primary barrel means or said secondary projectile from said secondary barrel means, said launching means being selectively actuatable for alternatively delivering a blast of compressed air to said primary barrel means for launching said primary projectile therefrom or for delivering a blast of compressed air to said secondary barrel means for launching said secondary projectile therefrom.

* * * * *